United States Patent [19]

Swenson

[11] 4,070,034

[45] Jan. 24, 1978

[54] ADJUSTABLE RELEASE HEEL SKI BINDING

[76] Inventor: Glen R. Swenson, 3152 Valley, Salt Lake City, Utah 84109

[21] Appl. No.: 708,917

[22] Filed: July 26, 1970

Related U.S. Application Data

[63] Continuation-in-part of Ser. No. 571,513, April 25, 1975, Pat. No. 3,992,032.

[51] Int. Cl.[2] ..... A63C 9/08

[52] U.S. Cl. ..... 280/625; 280/631

[58] Field of Search ..... 280/625, 626, 627, 631, 280/632, 623

[56] References Cited

U.S. PATENT DOCUMENTS

| | | | |
|---|---|---|---|
| 3,241,849 | 3/1966 | Bodycomb | 280/632 |
| 3,350,110 | 10/1967 | Salomon | 280/632 |
| 3,724,868 | 4/1973 | Beyl | 280/631 |
| 3,902,730 | 9/1975 | Tschida | 280/625 |
| 3,920,256 | 11/1975 | Sittman | 280/625 |

*Primary Examiner*—Robert R. Song
*Attorney, Agent, or Firm*—K. S. Cornaby

[57] ABSTRACT

A heel ski boot binding for mounting onto a conventional snow ski is adapted to receive and releasibly maintain the heel of a conventional ski boot during normal skiing operations and to release the boot heel upon application of a predetermined vertical, lateral or torque force through the heel against the heel binding. The heel binding incorporates a biased clamp member that is compressed into a locked attitude against a top edge of the ski boot heel but can be released upon application of a predetermined vertical or torque force. The heel binding also incorporates one or more adjustable biased roller members adapted to be urged against the ski boot heel to secure the heel in position against the ski. The roller members release the ski boot when a predetermined lateral or rotational force is applied through the boot heel to the roller members. The biasing means of the roller members and clamp members are manually adjustable to set the amount of force necessary to overcome the bias and release the ski boot.

10 Claims, 7 Drawing Figures

FIG. 1.
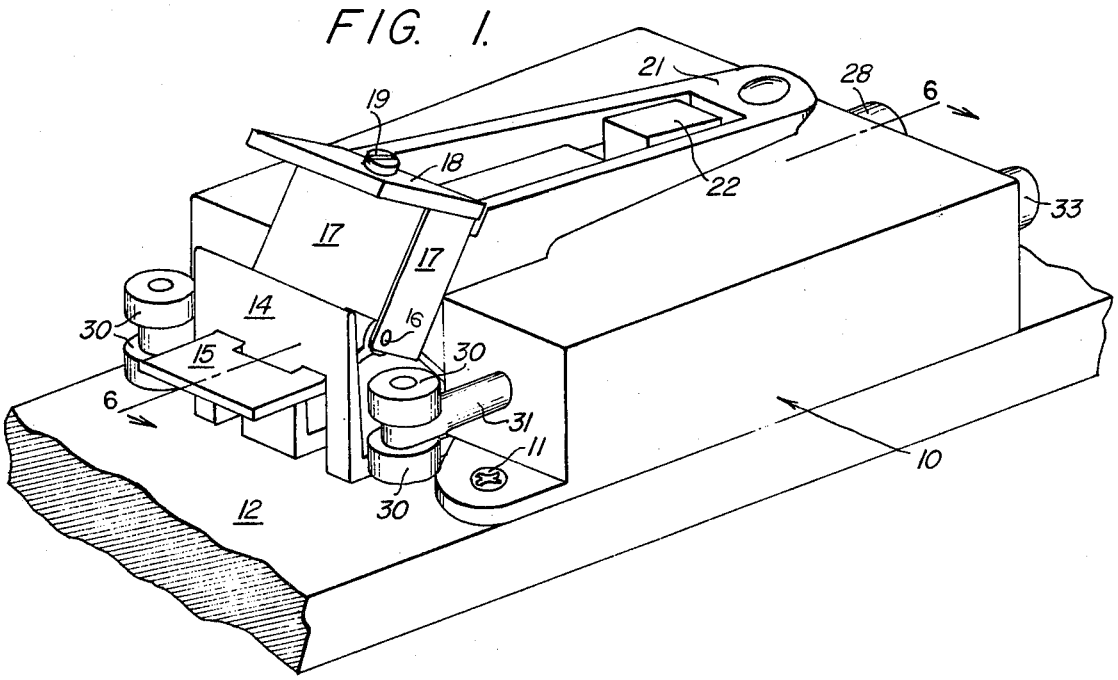
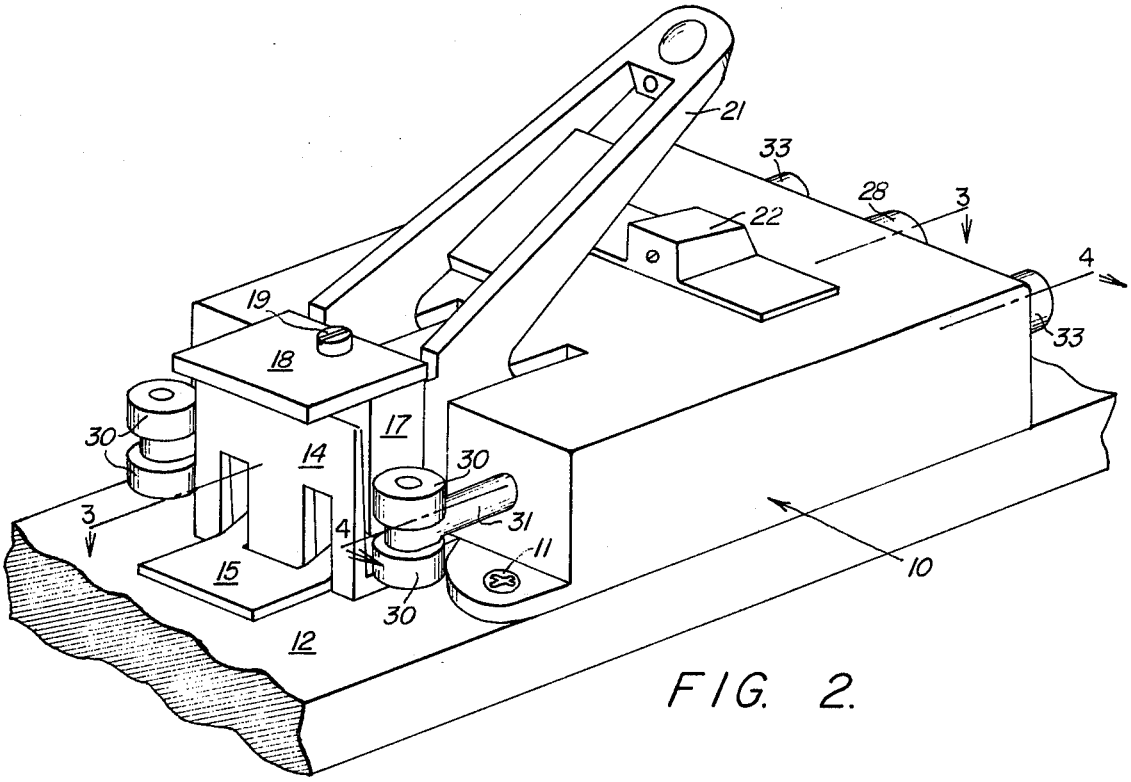
FIG. 2.

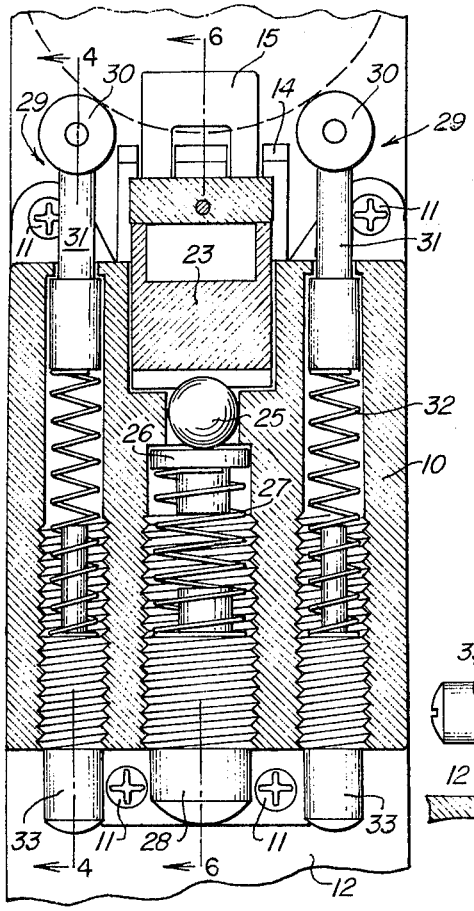
FIG. 3.
FIG. 5.
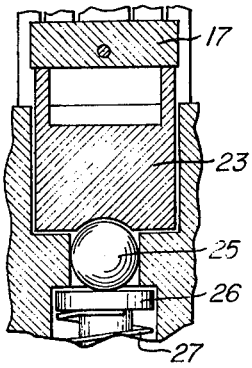
FIG. 4.
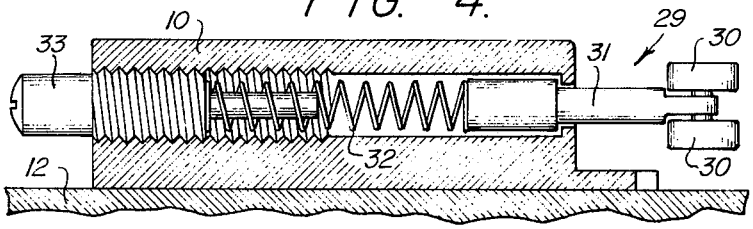
FIG. 6.
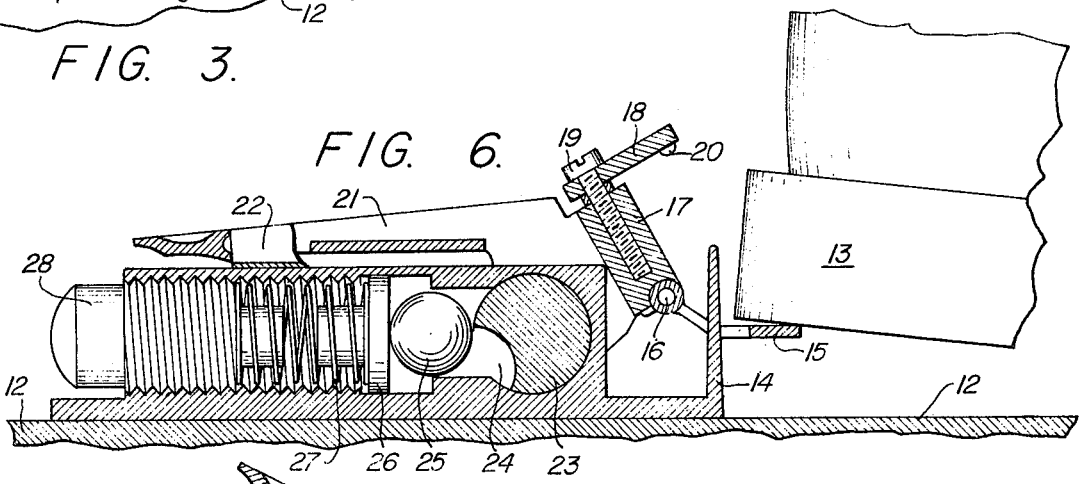
FIG. 7.
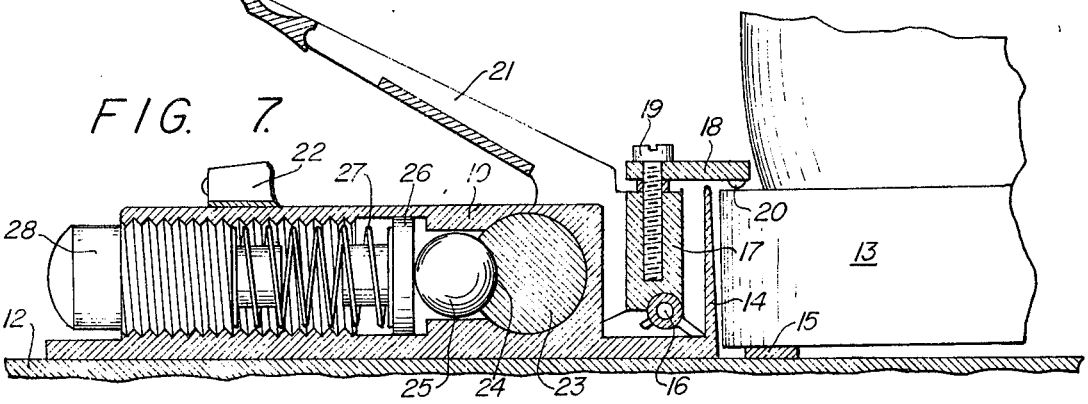

ADJUSTABLE RELEASE HEEL SKI BINDING

BRIEF DESCRIPTION OF THE INVENTION

RELATED APPLICATION

This application is a continuation-in-part application of copending parent application Ser. No. 571,513, filed Apr. 25, 1975, which has now issued as U.S. Pat. No. 3,992,032 on Nov. 16, 1976.

FIELD OF THE INVENTION

This invention relates to releasable heel bindings for maintaining the heel of a ski boot on the surface of a snow ski.

STATE OF THE ART

Ski bindings for snow ski boot heels are well known in the art and all have the objective of holding a ski boot heel in place on the surface of a snow ski; and preferably to provide a means for releasing the boot heel when a predetermined force is applied to the boat heel, such as in a fall or the like, in order to avoid injury to the skier. While much attention has been given in recent years to the improvement of toe bindings for ski boots to provide for quick release of the boot, most effort has been expended in improving heel bindings from the standpoint of vertical release. Almost uniformly, state of the art heel bindings are designed to release the boot heel in one direction only, usually vertically, in the event of a fall. Since heel bindings are constructed in a different design than the toe bindings, binding manufacturers have relied almost exclusively on toe bindings as the first line of defense in providing quick release of the ski boot. Once the toe binding has been released, the boot is expected merely to pull loose from the heel binding and then away from the ski.

Evidence indicates that the ski boot heel is subjected to as much or more vertical force in falls than the toe. The heel binding should be capable of releasing as quickly as the toe binding and in any direction following directional vector of the force, e.g. vertically, laterally or a combination of the two. Commercially dominant heel bindings known in the art do not have such multi-directional release capabilities and are not adapted to provide ease of access and release of the binding when placing the boot into or out of the binding in normal use.

OBJECTIVES

Accordingly, it is an objection of this invention to provide means for releasing a ski boot heel from a heel binding in any direction, including vertically, and laterally or any combination thereof.

It is a further objective of the invention to provide for timely release of a boot heel from the heel binding.

It is an additional objective to provide for adjustable securing means for a boot heel in a heel binding which can be adjusted normally and to oppose varying degrees of force exerted thereupon.

SUMMARY OF THE INVENTION

Principal features of the invention include a housing arranged to be permanently attached to the top surface of a snow ski, preferably by screws or the like. Clamp means extend from one end of the housing and is intended to receive and hold the heel of a ski boot while the ski boot is in position against the upper surface of a ski. The clamp means is adapted to rotate vertically against a biased detente designed to maintain the clamp means in a horizontal position in contact with the boot heel until a predetermined force exceeding the detente force is exerted by the boot heel to overcome the force of the detente and permit the clamp means to release the boot heel.

Biasing means for applying a predetermined amount of force to the clamp means to maintain the clamp means in a horizontal position is disposed within the housing and preferably is adjusted by means of a screw means extending from the opposite end of the housing from the end having the clamp means.

The clamp means preferably also has an elongate member rigidly attached at one end thereof to the clamp means and extending rearwardly over the top of the housing. The elongate member is adapted to permit a skier to release the clamp means from the boot heel manually by lowering the member and, hence, raising the clamp means.

At least one roller means also extends from the leading end of the housing, for example on either lateral side of the clamp means. The roller means has a roller rotatably mounted on a plunger rod extending into the housing and ending therein against biasing means, such as a spring, for applying a predetermined amount of pressure against the end of the plunger rod. Screw means extending from the opposite end of the housing preferably provide adjustment means for adjusting the amount of pressure exerted by the biasing means against the plunger rod.

The roller axis is essentially perpendicular to the upper surface of the ski and is arranged so that is engages the heel of the ski boot, preferably along the curvature of the heel toward the side thereof. In this manner a pair of roller means mounted on either side of the clamp means tend to maintain the position of the boot heel in the heel binding and prevent lateral movement of the boot heel during use. In the event the predetermined force applied to the roller means by the bias means is overcome by a torque force applied to the boot heel as by a fall, the roller means release the heel and permit the heel to move laterally out of the binding to prevent injury to the skier.

THE DRAWINGS

The best mode presently contemplated for carrying out the invention is ullustrated in the accompanying drawings, in which:

FIG. 1 is a perspective view of the heel ski binding showing the clamp means in the open position;

FIG. 2 is a perspective view of the heel binding similar to that shown in FIG. 1, with the clamp means in closed position for contact with the boot heel;

FIG. 3, a top plan sectional view of the binding taken along line 3—3 of FIG. 2;

FIG. 4, a side elevational sectional of the binding taken along line 4—4 of FIG. 2;

FIG. 5, a top plan sectional view of the clamp means detente mechanism of the binding;

FIG. 6, a side elevational section of the binding taken along line 6—6 of FIG. 1 showing a boot heel in outline in position in the open clamp; and FIG. 7, a side elevational section of the binding taken along line 7—7 of FIG. 2, showing a boot heel in outline in position with the closed clamp.

DETAILED DESCRIPTION OF THE ILLUSTRATED EMBODIMENTS

As shown in FIGS. 1 and 2 of the drawings, a first embodiment of an adjustable release binding of the invention is constructed preferably of metal, such as aluminum, steel, or other durable material such as plastic or the like, and has a housing 10 adapted to be attached by appropriate means, such as screws 11 or the like as shown, to the upper surface of a snow ski, shown in the drawing in cut-away as 12.

In this particular embodiment, the clamp means for holding a ski boot heel 13 shown in FIGS. 3, 6 and 7, against the surface of the ski 12 include a stationary heel butt plate 14 rising essentially perpendicularly from the surface of the ski 12 and attached to the forward part of housing 10. A flat step plate 15 extends laterally forwardly from housing 10 through apertures in butt plate 14 and is designed to engage the lower surface of the boot heel 13 as the heel is placed into position on the ski. As heel 13 moves downwardly against the upper surface of step plate 15, plate 15 moves downwardly to the surface of the ski as shown in FIGS. 1 and 2 and also in FIGS. 6 and 7.

Step Plate 15 is rotatably attached at laterally directed axis 16 to the lower end of a bar member 17 behind butt plate 14. Bar member 17 rises to adjustable attachment at its upper end with a forwardly extending clamp 18. Clamp 18 is in perpendicular relationship with bar member 17. As step plate 15 is moved downwardly by pressure from heel 13, clamp moves downwardly from a position above the horizontal into a horizontal position over the upper edge of heel 13, as shown most clearly in FIG. 7. To accommodate different thicknesses of heels, clamp 18 is moveably secured to bar member 17 by screw means shown here as screw 19. A small round extension 20 is attached below clamp 18 to more securely engage clamp 18 with boot heel 13.

Bar member 17 in this embodiment has an elongate member 21 extending upwardly and rearwardly of the bar member over the top of housing 10 for providing a means of disengaging clamp 18 from contact with the boot heel when a skier desires to take the skies off. By depressing elongate member 21 the clamp is released. Member 21 can be secured in the down position by attaching member 21 to a securing member, such as a small box 22 housing a ball bearing on a spring (not shown) attached to housing 10 for holding the elongate member 21 against housing 10. Elongate member 21 can be activated for release of the boot by hand or the tip of a ski pole.

Bar member 17 is fixably attached to a laterally extending cylinder 23 which is notched 24 along the elongate side toward the rear of housing 10, as shown in FIGS. 6 and 7 and is rotatingly disposed within housing 10. Notch 24 is adapted to accommodate a ball 25 rotatingly disposed within housing 10 when the clamp 18 is in the down position. Ball 25 is urged against cylinder 23 by biasing means, in this embodiment shown as a plate 26 urged against ball 25 by a spring 27 extending rearwardly of the housing to screw means 28 projecting outwardly from the rear of housing 10. Screw means 28 is rotatingly disposed in housing 10 and permits the adjustment of biasing force against spring 27 and ball 25. When clamp 18 is down in position over heel 13, ball 25 is in notch 24. A vertical or torque force, such as experienced in a ski fall or the like, sufficient to overcome the bias force exerted on the ball 25 rotates cylinder 23 and notch 24 out of contact with ball 25 and thus permits clamp 18 to move upwardly thereby freeing the boot heel.

As shown in a sectional view of FIGS. 3 and 4, the binding in this embodiment has two spring-loaded roller means 29 extending forwardly from the housing 10 respectively on either lateral side of clamp 18 to engage boot heel 13 preferably at points of the heel where the heel rounds from the back of the boot forwardly to the front of the boot. Each roller means 29 includes a roller or a pair of rollers 30 on an essentially vertical axis rotatingly attached to a plunger rod 31 which extends into the forward end of housing 10 and engages at its other end spring biasing means 32. Spring biasing means 32 are connected at the other end thereof to adjustable screw means 33 extending from the rearward force of housing 10. By rotating screw means 33, the biasing force on the spring biasing means 32 and rollers 30 can be adjusted, thereby the pressure of rollers 30 against heel 13 can be determined as desired. Torque or lateral force exerted on heel 13 sufficient to overcome the biasing force of springs 32 on rollers 30 permit heel 13 to slide laterally out of the binding in the event of an accident or the like.

Although preferred embodiments of the invention have been disclosed herein, it is to be understood that this disclosure is made by way of example and that variations are obvious to one skilled in the art as coming within the scope of the invention as defined by the appended claims.

I claim:

1. An adjustable release ski binding comprising in combination:

a housing for attachment to a ski;

means for attaching said housing to a ski;

clamp means extending outwardly from said housing to engage the top surface of the heel of a ski boot when the boot is in position on a ski, said clamp means having a clamp member arranged to pivot vertically from a normally horizontal attitude;

biasing means disposed in said housing for urging said clamp means in a horizontal attitude with respect to a ski surface;

means for adjusting the biasing force exerted by said biasing means to maintain said clamp means in the normally horizontal attitude;

a pair roller means extending outwardly from said housing respectively on each side of said clamp means to engage the rearward curved end portion of said ski boot heel for resiliently resisting lateral displacement of the heel when in position on a ski;

biasing means disposed in said housing for urging said roller means against said rearward curved end portion of said ski boot heel; and separate means for adjusting the biasing force exerted by said biasing means against said roller means.

2. An adjustable release ski binding as set forth in claim 1, wherein said clamp means comprises a pair of flat tabs arranged in parallel relationship one above the other for resting respectively along the upper and bottom surfaces of a ski boot heel; and said clamp means including means for manually releasing and setting said clamp member and a pivot connected to said pair of tabs rotatably disposed in said housing.

3. An adjustable release ski binding as set forth in claim 1, wherein said biasing means for said clamp means comprise piston means slideably mounted in said housing so that one end thereof abuts the clamp means, and a spring compressably mounted in said housing so as to act upon said clamp means to resist vertical rotation of said clamp means.

4. An adjustable release ski binding as set forth in claim 1, wherein said means for adjusting the biasing force on said clamp means comprises a manually rotatable screw means disposed in said housing.

5. An adjustable release ski binding as set forth in claim 1, wherein said roller means comprises at least one roller rotatably attached to piston means slideably mounted in said housing, said roller being so arranged as to rotate on an axis perpendicular to the surface of the ski to which the binding is secured.

6. An adjustable release ski binding as set forth in claim 1, wherein said biasing means for said roller means comprises a spring means compressably arranged in said housing in contact with said roller means.

7. An adjustable release ski binding as set forth in claim 1, wherein said means for adjusting the biasing force exerted by said roller biasing means comprises a rotatably mounted screw-means for unusual operation.

8. An adjustable release ski binding as set forth in claim 1, including a pair of roller means, a pair of biasing means for said respective roller means and a pair of means for adjusting the biasing force for respective roller means; said pair of roller means being disposed respectively on either lateral side of said clamp means.

9. An adjustable release ski binding as set forth in claim 1, including a pair of clamp means disposed respectively on either lateral side of said roller means and including respective biasing means and means for adjusting the biasing force for each clamp means.

10. An adjustable release ski binding as set forth in claim 1, including an elongate member attached to said clamp means for manually overcoming the bias force exerted against said clamp means to maintain the clamp means in the normally horizontal attitude.

* * * * *